United States Patent [19]

Mason

[11] 3,946,476

[45] Mar. 30, 1976

[54] AUTOMATIC MULTI-CONDUCTOR QUICK CONNECT TERMINATION TOOL

[75] Inventor: John Richard Mason, Thousand Oaks, Calif.

[73] Assignee: Dracon Industries, Chatsworth, Calif.

[22] Filed: Jan. 22, 1975

[21] Appl. No.: 542,962

[52] U.S. Cl. ..... 29/203 H; 29/203 HC

[51] Int. Cl.[2] ..... H01R 43/04

[58] Field of Search..... 29/203 H, 203 HC, 203 HT, 29/203 DT, 203 MW, 628; 7/14.1 R

[56] References Cited

UNITED STATES PATENTS

| | | | |
|---|---|---|---|
| 3,168,750 | 2/1965 | Gattiker, Jr. | 7/14.1 R |
| 3,708,852 | 1/1973 | Mason | 29/203 H |
| 3,711,921 | 1/1973 | Debortoli et al. | 29/203 H |
| 3,733,674 | 5/1973 | Shirley | 29/203 HC |
| 3,866,294 | 2/1975 | McCaughey | 29/203 H |

*Primary Examiner*—Carl E. Hall
*Attorney, Agent, or Firm*—Flehr, Hohbach, Test, Albritton & Herbert

[57] ABSTRACT

A termination tool for simultaneously attaching "tip and ring" conductors to adjacent bifurcated electrical terminals on a multiple-terminal block. The multi-conductor termination tool picks up a pair of separate conductors, seats them in adjacent electrical terminals, and cuts the wire on one side of each terminal. The tool has a handle containing an impact device which provides an impulse to a tool termination head adapted to receive the adjacent electrical terminals. The termination head partially seats the conductors in the bifurcated terminals with an initial downward force applied to the handle. The complete conductor seating in the terminals and cutting of the conductors on one side of the terminals is accomplished by the impulse delivered by the impact device.

4 Claims, 5 Drawing Figures

FIG.—2
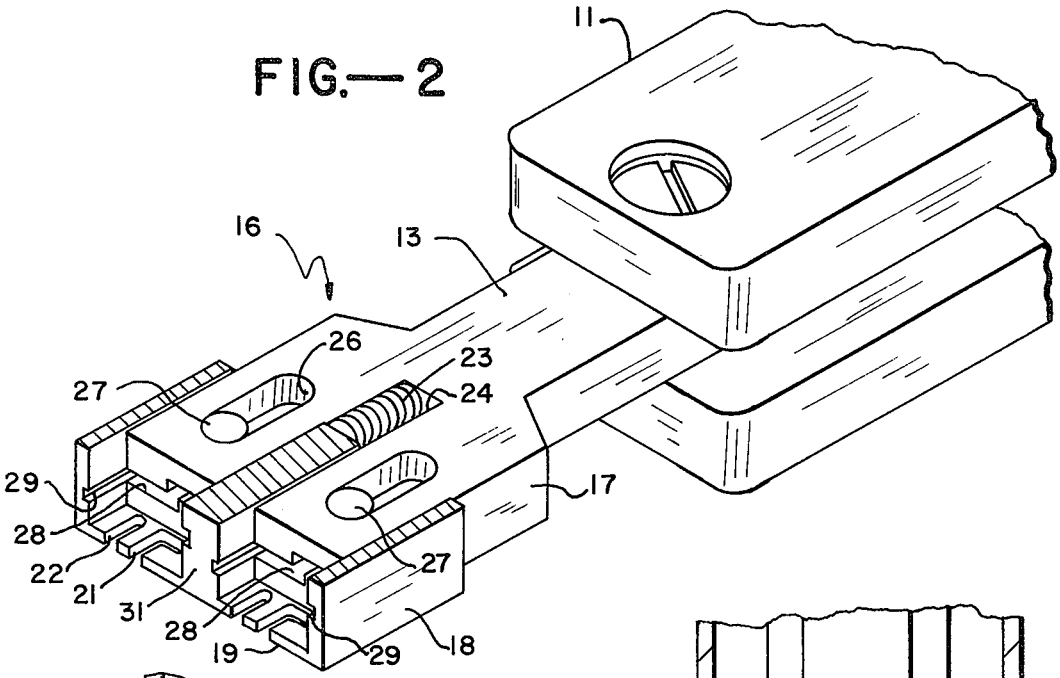
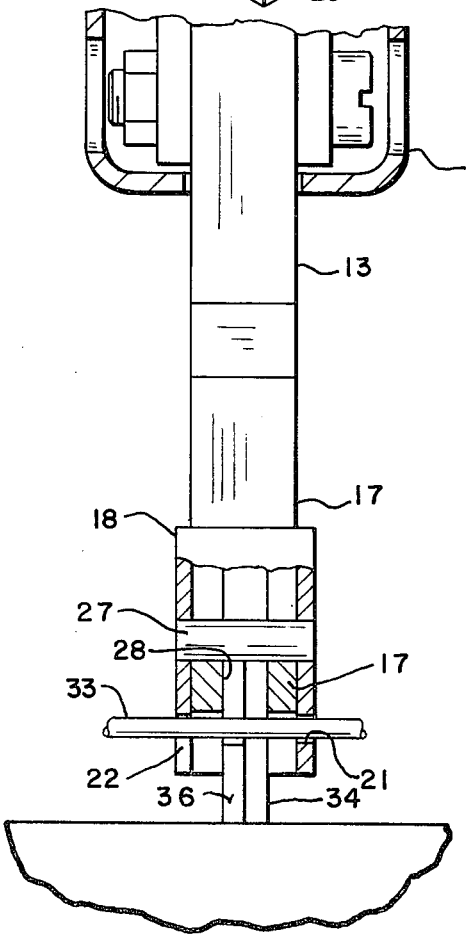
FIG.—3
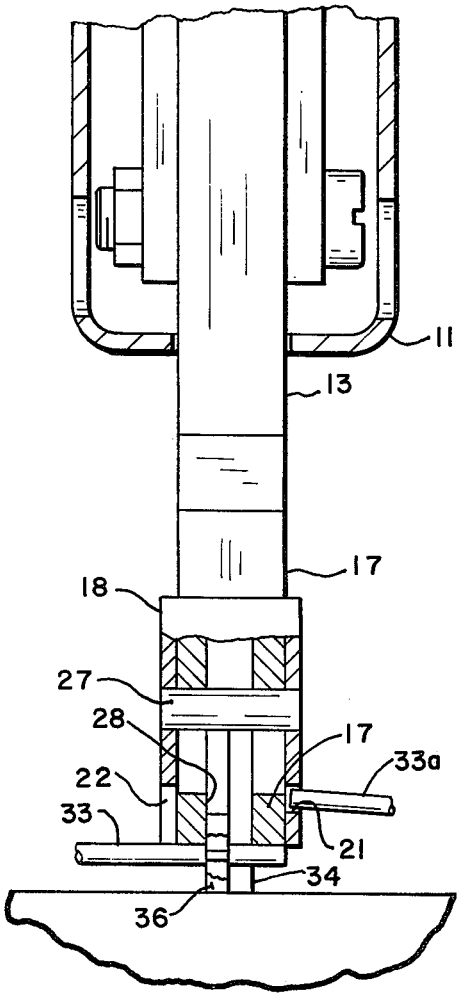
FIG.—4

AUTOMATIC MULTI-CONDUCTOR QUICK CONNECT TERMINATION TOOL

BACKGROUND OF THE INVENTION

This invention relates to a multi-conductor termination tool for simultaneous insertion of multiple conductors in adjacent bifurcated electrical terminals and particularly to such a tool for simultaneously seating and cutting the conductors at the terminals.

Termination of conductors in telephone system terminal blocks, such as the 78B164 quick-connect terminal block, has in the past required individual conductor attachment to respective terminals. Each conductor was required to be premeasured for extending between the designated terminals for connection, and thereafter cut and inserted one wire at a time in each terminal. The installation of "tip and ring" conductors in adjacent electrical terminals in thousands of quick-connect terminals contained in main distribution frames, can easily be seen to require an excessive amount of time and attention on the part of telephone system installation personnel.

There is therefore a need for a multi-conductor termination tool for eliminating the premeasuring and precutting of conductors which are to be terminated at adjacent electrical terminals.

SUMMARY AND OBJECTS OF THE INVENTION

The invention disclosed herein is directed to a multi-conductor termination tool which functions to attach electrical conductors to adjacent bifurcated electrical terminals on multiple terminal blocks. The tool includes a handle for tool engagement, and an impact device within the handle for providing an impulse. An elongate member extends from the handle for slidable motion therewith and attached to the impact device. A termination head is mounted on the extended end of the elongate member including an inner block attached to the elongate member and adapted to receive the adjacent electrical terminals. An outer shear sleeve surrounds the inner block for sliding motion on the block. The shear sleeve has one edge extending beyond the inner block, the one edge having alternating straight and angle slots on each side thereof extending toward the inner block. The straight slots on one side of the shear sleeve are opposite angle slots on the other side thereof. The slots have widths for accepting electrical conductors. When the electrical conductors are placed in one of the straight slots and in one of the opposing angle slots and the inner block is placed over adjacent bifurcated terminals to which connection is to be made, a force applied to the handle toward the terminal will partially seat the conductors in the terminals. Additional force causes the elongate member to actuate the impact device providing an impulse to the inner block for shearing the conductors at the angle slot and seating the conductors in the adjacent terminals.

It is therefore an object of this invention to provide a multi-conductor termination tool for elimination of premeasurement and precutting of terminal block connection wires.

It is another object of the present invention to provide a multi-conductor termination tool which provides effortless simultaneous connection of more than one conductor to adjacent electrical terminals.

Additional objects and features of the invention will appear from the following description in which the preferred embodiment has been set forth in detail in conjunction with the accompanying drawings.

BRIEF DESCRIPTION OF THE DRAWINGS

FIG. 2 is an isometric cut-away view of the termination head on the multi-conductor termination tool.

FIG. 3 is a side elevation partial cut-away view of the termination head in an initial engaging position.

FIG. 4 is a side elevation partial cut-away view of the termination head in a final engaging position.

DESCRIPTION OF THE PREFERRED EMBODIMENT

Figure 1:
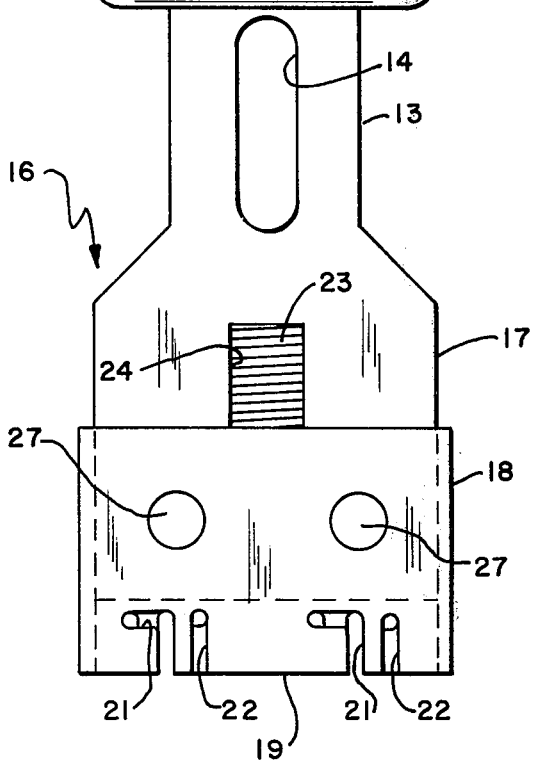
FIG. 1 is a front elevation view of the multi-conductor terminal tool.

The automatic quick-connect termination tool for multiple conductors disclosed herein is seen in FIG. 1 as having a handle 11 shaped for manual engagement. Contained within handle 11 is an internal cavity 12 within which is contained an impact device for providing an impulse. The impact device in cavity 12 may be of the configuration described in U.S. Pat. No. 3,708,852, shown within the handle of the device disclosed therein, and forms no part of the disclosed invention here. An elongate member 13 is in communication with the impact device contained in cavity 12, and extends from one end of handle 11 for longitudinal sliding motion therewith. Elongate member 13 has an elongate aperture 14 formed therein for lightening purposes in this embodiment. A termination head shown generally at 16 is mounted on the end of elongate member 13 so that the impulse from impact device in cavity 12 may be transmitted thereto by elongate member 13.

Termination head 16 has an inner block 17 surrounded by a jacket or shear sleeve 18 which is formed for slidable motion on inner block 17. Shear sleeve 18 has one edge 19 which extends beyond the end of inner block 17. The one edge 19 has formed therein alternate angle slots 21 and straight slots 22 as seen in FIGS. 1 and 2. As shown in FIG. 1 it may be seen that an angle slot 21 on one side of shear sleeve 18 is opposite a straight slot 22 on the opposite side of shear sleeve 18. Shear sleeve 18 is urged into the position having one edge 19 extending beyond the end of inner block 17 by a spring 23 mounted in a slot 24 in inner block 17.

Referring to FIG. 2 one side of shear sleeve 18 is cut away for exhibiting the details of inner block 17. Inner block 17 has a pair of elongate holes 26 therethrough for receiving pins 27 extending between the sides of shear sleeve 18 for holding the shear sleeve in a position surrounding inner block 17 while allowing slidable motion relative thereto. The end of inner block 17 has offset slots 28 formed therein for receiving bifurcated electrical terminals on a quick-connect terminal block to be hereinafter described. A pair of side slots 29 are formed on the inner surfaces of each side of shear sleeve 18 in juxtaposition with the outer edges of offset slots 28 for engaging the outer edges of adjacent bifurcated electrical terminals.

A central divider member 31 is located internally in shear sleeve 18 having an additional pair of side slots 32 therein for alignment with the inner edges of offset slots 28 for engaging the inner edges of adjacent bifurcated electrical terminals. Central portion 31 enters slot 24 bearing against one end of spring 23 so that spring 23 is trapped between the end of slot 24 and central portion 31. FIG. 2 shows spring 23 as a compression spring urging shear sleeve 18 to a position such that one edge 19 extends beyond the end of inner block 17 as described above. The extension of one edge 19 is limited by pins 27 as they engage one end of elongate holes 26.

Turning now to FIG. 3 the termination tool is seen carrying a conductor 33 leading in from another terminal to the left of FIG. 3, through straight slot 22 on one side of shear sleeve 18 and through angle slot 21 on the opposite side of shear sleeve 18. Angle slot 21 is shown in this embodiment as having an "L" shape, with a portion running perpendicular to and intersecting one edge 19, and a contiguous portion running substantially parallel thereto. Conductor 33 is laid into that portion of angle slot 21 which runs approximately parallel to one edge 19 of shear sleeve 18. Offset slots 28 in inner block 17 are shown receiving a pair of bifurcated electrical terminals 34 therein. Conductor 33 is shown poised above a split or bifurcation 36 in terminals 34. Downward pressure in the direction of arrow 37 is exerted on handle 11 for partially seating conductor 33 in the bifuraction 36. Additional downward force in the direction of arrow 37 applied to handle 11 will trip the impact device contained in cavity 12, thereby providing an impulse through elongate member 13 to inner block 17. As seen in FIG. 4, inner block 17 is driven downward by the impulse, forcing conductor 33 ahead of inner block 17 into the bifurcation 36. Entry of conductor 33 into bifurcation 36 strips the insulation therefrom leaving a bare wire conductor in electrical contact with terminal 34. Conductor 33 has at the same time been pushed downwardly in straight slot 22. Inner block 17 shears conductor 33 at the angle slot 21, thereby cutting the conductor on one side of bifurcated terminal 34, severing conductor 33 from that portion of the conductor 33*a* which is not terminated.

Figure 5:
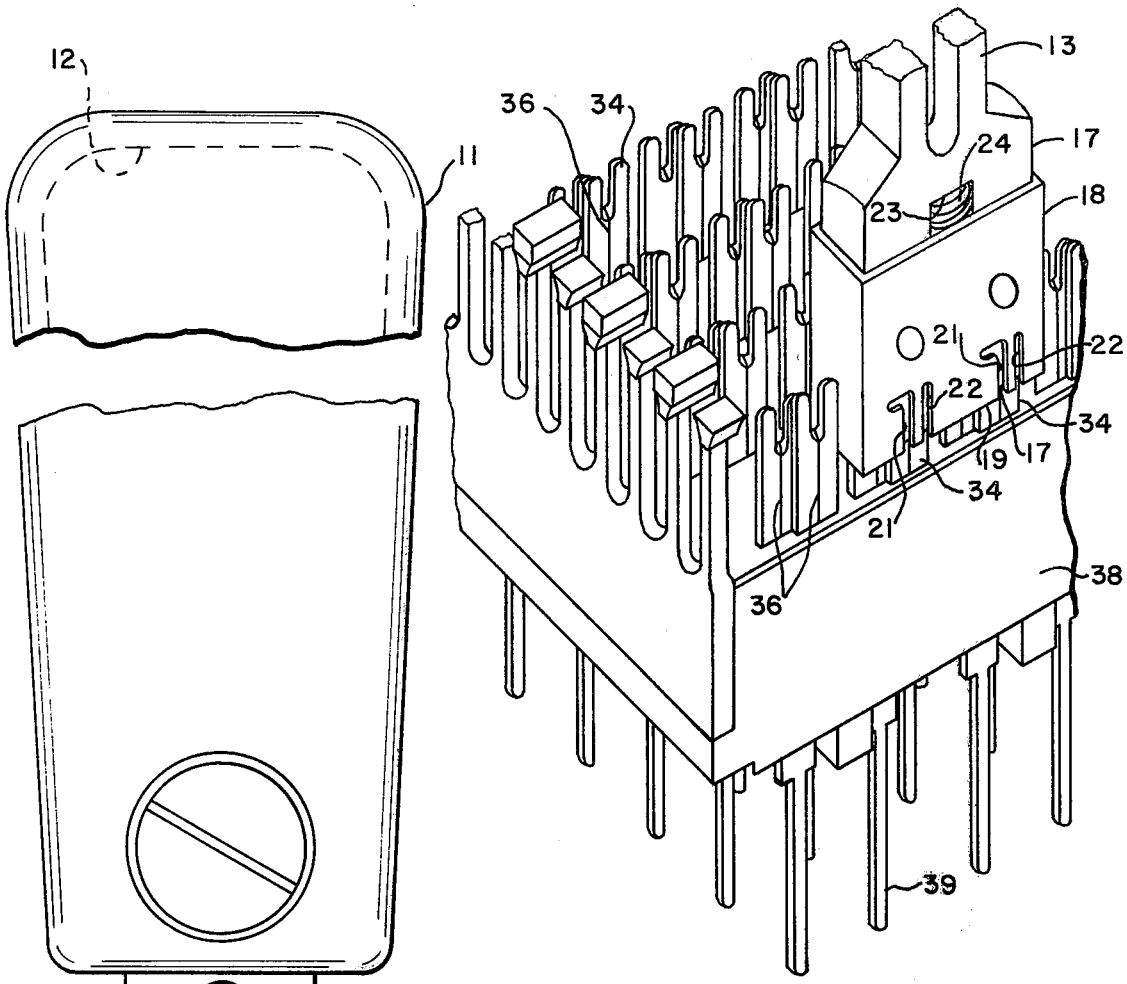
FIG. 5 is an isometric cut-away view of the termination head receiving adjacent bifurcated electrical terminals on a terminal block.

Terminals 34 are typically arranged in an array of adjacent terminals 34 in a terminal block 38 as seen in FIG. 5. Terminal block 38 has extending therefrom a series of electrical contacts 39 attached to individual ones of the bifurcated terminals 34. The termination tool disclosed herein is shown engaging adjacent bifurcated terminals 34 in offset slots 28 contained in inner block 17. Shear sleeve 18 is shown in the final engaging position of FIG. 4, after the impulse has driven inner block 17 into a position juxtaposed with the one edge 19 of shear sleeve 18.

As described above, when the termination tool has had sufficient downward force applied to place the inner block 17 and the shear sleeve 18 in relative position as shown in FIG. 5, conductors 33 passing through angle slot 21 will be sheared at the angle slots, and conductors passing through the straight slots 22 will be seated in the bifurcations 36 in terminals 34. In this fashion a pair of conductors 33 may be simultaneously seated in adjacent terminals 34 and cut on the side of the terminal toward which angle slot 21 is disposed.

A multi-conductor termination tool has been disclosed which eliminates premeasuring and precutting of conductors for termination at a terminal block and which provides for simultaneous connection of "tip and ring" conductors at adjacent bifurcated terminals.

What is claimed is:

1. A multi-conductor termination tool for attaching electrical conductors in electrical contact with a pair of adjacent bifurcated electrical terminals on a multiple terminal block comprising a handle, an impact device in said handle for providing an impulse, an elongate member extending from said impact device for slidable motion with said handle, a termination head, an inner block in said termination head attached to one end of said elongate member, said inner block having a pair of slots therein adapted to receive the pair of adjacent electrical terminals, an outer jacket surrounding said inner block for slidable motion thereon and having an open end extended therefrom, said outer jacket having opposing straight and L-shaped slots aligned with each of said pair of slots in said inner block and extending to the open end of said jacket, said opposing slots being formed to accept the electrical conductors, so that when the electrical conductors are positioned in ones of said straight slots and through said opposing L-shaped slots, said impulse is transmitted through said elongated member to said inner block for cutting the electrical conductors on the side of the L-shaped slot, and for seating the electrical conductors in the adjacent pair of bifurcated terminals.

2. A multi-conductor termination tool as in claim 1 together with means for urging said outer jacket toward said extended open end, whereby said straight and L-shaped slots are available to receive the electrical conductors prior to application of force to said handle sufficient to overcome said means for urging.

3. A multi-conductor termination tool for seating electrical conductors in adjacent bifurcated electrical terminals comprising an impact device, a handle for enclosing said impact device, an elongate member extending from said handle in contact with said impact device, a block mounted on the extended end of said elongate member having offset slots formed therein adapted to receive the adjacent bifurcated terminals, a sleeve for slidable motion on said block, said sleeve having one end extending beyond the edge of said block, said one end having a pair of straight slots and a pair of angle slots for each of said offset slots in alternating sequence on each side of said one end, said straight slots on one side being opposite said angle slots on the other side, said slots having a width for accepting the electrical conductors, so that when conductors are inserted in ones of said straight slots on one side and in said opposite angle slots on the other side, said block is placed over adjacent terminals and a force sufficient to actuate said impact device is exerted on said handle toward said block, an impulse is provided by said impact device for driving said block through said sleeve, thereby cutting the conductors at the angle slot and seating the conductors in the adjacent bifurcated terminals.

4. A termination tool for seating electrical conductors in adjacent bifurcated terminals and cutting the conductors on one side of the bifurcated terminal comprising a handle, an impulse generator in said handle, an elongate member attached to said impulse generator extending from one end of said handle, a block attached to the extended end of said elongate member, said block having slots formed in one edge thereof for receiving the bifurcated terminals, a shear sleeve surrounding said block for sliding motion thereon, and having one end extending beyond said edge of said block, and opposing first and second slots on opposite sides of said shear sleeve for holding the conductors, said first slot running parallel to said one edge and said second slot running perpendicular thereto, so that then an impulse is produced by said impulse generator the conductors are seated in the bifurcated terminals and are cut on the side of said first slot.

* * * * *